US006920644B1

(12) United States Patent
Higgs

(10) Patent No.: US 6,920,644 B1
(45) Date of Patent: Jul. 26, 2005

(54) CAP WITH STRETCHABLE BAND

(75) Inventor: Michael Higgs, Eastwood (AU)

(73) Assignee: Uni-Fit Headwear Pty Ltd, Eastwood (AU)

( * ) Notice: Subject to any disclaimer, the term of this patent is extended or adjusted under 35 U.S.C. 154(b) by 345 days.

(21) Appl. No.: 09/786,005

(22) PCT Filed: Jul. 14, 2000

(86) PCT No.: PCT/AU00/00847

§ 371 (c)(1),
(2), (4) Date: May 16, 2001

(87) PCT Pub. No.: WO01/05259

PCT Pub. Date: Jan. 25, 2001

(30) Foreign Application Priority Data

Jul. 14, 1999 (AU) ..... PQ1634
Feb. 18, 2000 (AU) ..... PQ5741

(51) Int. Cl.[7] ..... A42B 1/00
(52) U.S. Cl. ..... 2/195.3
(58) Field of Search ..... 223/84, 24, 12; 2/195.3

(56) References Cited

U.S. PATENT DOCUMENTS 5,428,843 A * 7/1995 Clowers et al. ..... 2/183
5,632,046 A * 5/1997 Green et al. ..... 2/183
5,715,540 A * 2/1998 Cho ..... 2/183
5,724,675 A 3/1998 Lipkin
5,966,742 A * 10/1999 Cunliffe ..... 2/181

FOREIGN PATENT DOCUMENTS

WO WO95/01738 A 1/1995
WO WO95/131713 A 5/1995

* cited by examiner

*Primary Examiner*—John J. Calvert
*Assistant Examiner*—James Smith
(74) *Attorney, Agent, or Firm*—Lackenbach Siegel, LLP

(57) ABSTRACT

A peak cap (1) having a crown (2) with an inner elastically stretchable band (13) positioned to extend at least partway along a lower encircling edge (10) and a liner of stretchable fabric (12) secured to be on an inner side of the elastic material of the band (13). Also described is a band with the liner in the form of a sleeve (23) through which an elastic member (24) extends and where the liner but not the elastic material is secured to the lower edge of the crown (2).

21 Claims, 7 Drawing Sheets

CAP WITH STRETCHABLE BAND

This application claims Paris Convention priority of Australian Application Nos. PQ1634 filed Jul. 14, 1999 and PQ5741 filed Feb. 18, 2000, the complete disclosure of which is(are) hereby incorporated by reference.

An object of this invention is to provide a cap that is able to fit a range of head sizes in a way that is comfortable in relation to the prior art or at the least will provide the public with a useful alternative.

In one form of this invention this can be said to reside in a cap having a crown with a lower encircling edge, an inner band within the crown having a lowermost edge secured to, at least, the lower encircling edge of the crown, the band being elastically stretchable at the least along its direction of elongation, the band including a linear positioned so as to have at least a portion of the liner at the least on an inner side of elastic material of the band.

In a further form of this invention in preference resides in a cap having a crown with a lower encircling edge, a peak extending outwardly from a portion only of the lower encircling edge, an inner band within the crown having a lowermost edge secured to, at least, the lower encircling edge of the crown, the band being elastically stretchable at the least along its direction of elongation, and a knitted liner secured on an inner side of the band and extending fully around the inner perimeter of the lower encircling edge.

In preference, the crown is formed of a plurality of gores which are of a material which will stretch at the least so as to allow for a change in size of at least the lower encircling edge of the crown.

In preference, the material of at least one of the gores is woven so that the woven strands in one direction allow for substantial elastic stretching while the strands in the other direction do not allow for substantial elastic stretching.

In preference, the inner band includes a sheet of material positioned between the inner band and the material of the gores to resist passage of sweat from the wearer therepast.

In preference, the inner band is both elastic and stretchable by reason of a knitted material having a plurality of strands some of which allow for substantial elasticity where the direction of elongation of such elastic strands are in the direction of elongation of the band.

In preference, the inner band includes material providing substantial elasticity in its elongation direction for a portion only of the inner perimeter of the encircling edge and there is provided for a remainder of the perimeter that the band is comprised of a material that does not exhibit substantial elasticity.

In preference, there are two gores forming the crown which are at a front of the cap and there is a stiffening reinforcement behind each of the gores secured to the gores so as to assist in maintaining a selected shape of the gores.

In preference, the liner located on an inner side of the band and extending fully around the inner perimeter of the lowest encircling edge is knitted.

In preference, the knitted inner liner is cotton towelling.

In preference, in manufacture, the knitted cotton towelling is stretched while being secured to the elastic portion of the inner band and the combination is then secured to the lower encircling edge of the cap while not being stretched.

The result of this last feature is that the elastic characteristic of the inner band then causes the knitted character of the cotton liner to compress but, because towelling of itself is quite soft, any deformation in shape will not effect such a concentration of pressure on a wearer's skin or scalp as might otherwise be the case.

In a further form the invention can be said to reside in a cap having a crown with a lower encircling edge, a peak extending outwardly from a portion only of the lower encircling edge, an inner band positioned to extend around the lower encircling edge and within the crown having a lowermost edge secured to the lower encircling edge of the crown, the crown being formed to be elastically stretchable to provide for elastic extension of the lower encircling edge of the crown, the band being elastically stretchable at the least along its direction of elongation, and a liner secured to be on an inner side of the band at least and extending to at least a substantial extent around the inner perimeter of the lower encircling edge.

In preference the liner is a knitted fabric.

In preference the liner is in the form of a sleeve through which the band extends, one side edge of the sleeve only, being secured to the lower encircling edge.

It is known to provide a so-called multi-size cap in which there is a crown with an open area at the back which can be pulled together by adjustment straps.

The look of such multi-size caps are considered to be disadvantageous and it would be preferred if it was reasonably feasible to provide free-size caps in most cases.

In a free-size cap, there is provided a crown which is formed from a plurality of pieces of material which together provide a continuously extending lower encircling edge and there is attached to the inside of such lower encircling edge, a band which is elastically extendible.

In such a way, at least some elastic tolerance can be achieved for persons having heads of different size and having the cap then fit such different sizes of head with reasonable appearance having generally the appearance of a separately tailored cap for such a head size.

A number of problems apply to such a simple proposal.

A first of these is that the material of the crown itself by having to be sewn to the elastic band, inhibits the degree to which the inner band, which is often referred to as a "sweatband" can be extended.

Attempts have been made to overcome this problem by using as the material of the crown or at least parts of it, a material which of itself can be expandable and, in particular, there has been used woven materials in which a warp is made from one material and the weft is made of another which is elastically extendible so that the material, at least predominantly in one direction, will be also expandable.

By sewing the elastic band directly to this then elastic material of the crown, allows for better elastic extension but unfortunately, there is still the problem that the method of attaching the sweatband to the material, at least in a way that is acceptable in commercial production, can inhibit the degree in which elastic extension can readily take place allowing a maximum extension without having to apply unnecessary pressure to the wearer to maintain this extension.

The problem has been then to ensure that one can attach an elastic band to cloth or fabric in such a way as to achieve reasonable elastic extension and as was previously stated, one approach has been to have the material from which the crown is made, expandable at least in one direction in relation to its weft and warp orientations noting that the crown can be made of various pieces of material and having such pieces variously orientated in relation to its weft and warp direction.

Further, it has been found to generally be uneconomic to try to maintain a common orientation of weft and warp directions of one piece as compared to others.

It is known that there is considerable attraction to a solution in connection with this type of design but attempts previously have had limitations both in respect of the degree of stretch that can be achieved with reasonable pressure limits as well as maintaining a good external appearance of a crown.

Generally then, the object of this invention is to provide the public with a useful alternative.

In a further preferred form of this invention there is proposed a cap having a crown with a lower encircling edge, an inner band within the crown having a lowermost edge secured by being sewn to at least the lower encircling edge of the crown, the band being composed of a sleeve of woven or knitted material of a type providing a soft interface between a wearer and a strip of elastic material within the sleeve, the strip of elastic material within the sleeve extending at least part way along the lower encircling edge of the crown, a bottom portion of the sleeve being secured to the lower encircling edge, and at least a lower portion of the elastic strip being not secured to the lower encircling edge at all, or being secured to the lower encircling edge of the crown only at substantially spaced apart locations.

By locating the elastic strip within a sleeve and not directly securing the lower portion of the elastic strip by means such as sewing or otherwise except at spaced apart locations allows the elastic strip to stretch in a way which is separate from restraints being applied by reason of a particular form of sewing, and in fact, if the sleeve is made from a material such as terry towelling, although this is a preferred material only, then there is considerable additional freedom available for the elastic to expand before the pressure needed to keep the expansion at its fullest extent becomes higher than is desirable.

Further, elastic by its nature applying with constant pressure, directly against the skin of a wearer, can cause considerable discomfort over time and yet hitherto, it would not have been considered appropriate because attaching any inner liner would, of itself, provide in addition to allowing for this further greater freedom of elastic expansion.

Again then, by having the elastic strip, and in preference this is a band, held within a sleeve of soft material which is knitted so as to allow for further soft reasonable expansion, allows for an interface to be located between the elastic strip and the wearer and this significantly increases a comfort factor.

In preference, the cap is of a type having a peak extending outwardly from an edge of the lower encircling edge.

In preference, the crown of the cap is comprised of a plurality of pieces of material, at least one of which is woven so as to have a weft and a warp and where at least one of these is an elastically stretchable material so as to allow for elastic extension of the lower encircling edge of the crown.

In preference, the elastic strip extends only part way around the lower encircling edge of the crown and in preference this is an extension from a location in the vicinity of one side of the peak from whence the direction of the elastic strip extends around the encircling edge around the back of the cap and then concluding in the vicinity of the opposite side of the peak as to where it is joined to the lower encircling edge of the crown.

In practice this arrangement has two advantages.

A first of these is that the peak of itself ensures that any material to which it is attached will not of itself be elastically expandable and invariably, the material of the crown in the vicinity of the peak is intended to be more rigid and provides some support for corporate logos or other insignia and to provide a styling.

As a consequence, it is preferred that the arrangement at the front of the cap which is on the inner side of the lower encircling edge generally between the areas defined by the peak, then include a moisture impermeable material, and a soft interface material but not such that there is substantial elastic stretchability. This then assists in minimising the amount of perspiration that might pass from the wearer through to the material from which the front of the crown is formed.

In preference, the sleeve which forms the outer portion of the band, is formed from terry towelling which is folded so as to provide a sleeve shape and in which the overlapping edges are in the vicinity of the lower encircling edge and are sewn to an upturned inner portion of the crown at this location.

Such a terry towelling material is chosen from terry towelling which is provided from a roll where the direction of the knitting shape is chosen so that there will be, in the elongation direction of this sleeve, a stretch potential of significance.

In preference, the elastic strip is in fact a band which is held fully within the sleeve formed from the terry towelling and which is secured to the sleeve only at substantially spaced apart locations which in preference means that it is secured by being sewn to the terry towelling only and at a spacing of approximately a quarter circular distance which is to say that in a preferred example, the elastic strip will be secured at five places where two of these are in the adjacent vicinity of the peak of the cap, two of these are on the ends of a diameter which is directly transverse to a forward to rearward direction of the cap, and one of these is at a rearward most position of the cap.

What this does then is allow the elastic band material to expand or stretch with a relative degree of freedom both from the sleeve and surrounding crown but in the preferred example where some of the crown material includes expandable materials, this is arranged so that the lower encircling edge also will contribute to further elastic expansion.

The results of such an arrangement have been significant insofar that we have now been able to obtain significantly further elastic expansion while keeping the extent of the pressure applied still comfortable and, as well, still having a comfortable interface between any elastic material which would normally be quite hard against the surface of a wearer, now mitigated by the softness of the interface material.

These and other improvements are all considered to be within the scope of this general invention.

For a better understanding of this invention it will now be described with reference to two embodiments which shall be described with the assistance of drawings wherein.

Figure 1:
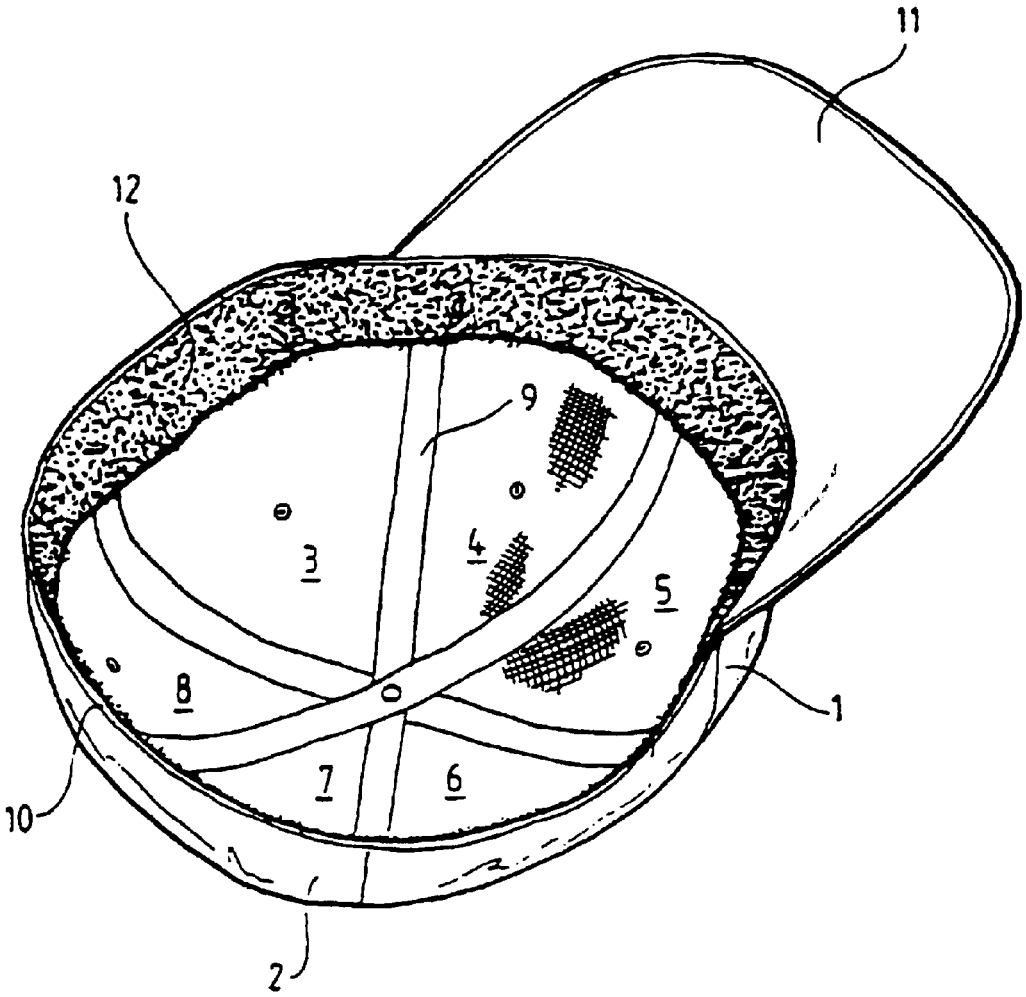
FIG. 1 is a perspective view of a cap according to the first embodiment shown from an underneath side.

Referring in detail to the drawings and especially FIGS. 1 through 6, there is provided a cap 1 which has a crown 2 which is made from a plurality of pieces of material of generally triangular shape conventionally referred to in the trade as "gores" shown at 3, 4, 5, 6, 7 and 8 which are joined together with an inner tape shown typically at 9.

This allows for a generally semi-spherical shape to be formed with the gores providing a lowermost encircling edge 10.

The edge 10 can, in some cases, have additional materials attached, for instance, in the case of ear muffs but conventionally, the encircling edge 10 is the lowermost edge.

Secured to this lowermost edge is a peak 11 which is sewn into the material from which the gores are formed so as to be secured to part only of the encircling edge 10.

The problem addressed by this invention is firstly directed to the quest for a cap that will be able to be worn by persons with different head size without either adjustment of some interlocking character or buckle or having to break the continuity of the encircling lowermost edge 10 so that by wearing such a cap, it has the appearance of a fully fitted cap.

It has been previously proposed that having the gores made from an elastic material or at least stretchable, and then having an inner band that will also stretch with the lowermost encircling edge, will provide a good answer.

The problem has been discovered however that if a fully encircling elastic woven material is used as the inner band, that this has a tendency to cause irritation to a wearer by reason of the constant elastic pressure being applied to the head.

Further, by reason of the characteristics of a woven elastic band, the impression of the individual parts of the band act as stress or pressure concentrators with the result that either the cap is considered after a period, to be uncomfortable or it will leave unsightly pressure marks on the forehead of a wearer.

The answer according to this invention has been to provide a further softer material which also can provide a dissipation of localised pressure points so that this inner liner will be positioned between the elastic material and a wearer's head.

In this embodiment there is used an inner liner of terry towelling shown at 12 which fully encircles the inner perimeter of the crown 2.

The liner itself, being made of towelling which is a knitted cotton, is found to have two further characteristics which are of advantage.

A first of these is that it will be able to stretch and be compressible by reason of its knitted character and secondly by reason of the way in which the knitting occurs, it has a bulk which provides for a soft interface between a harder elastic liner and the wearer's skin.

Figure 2:
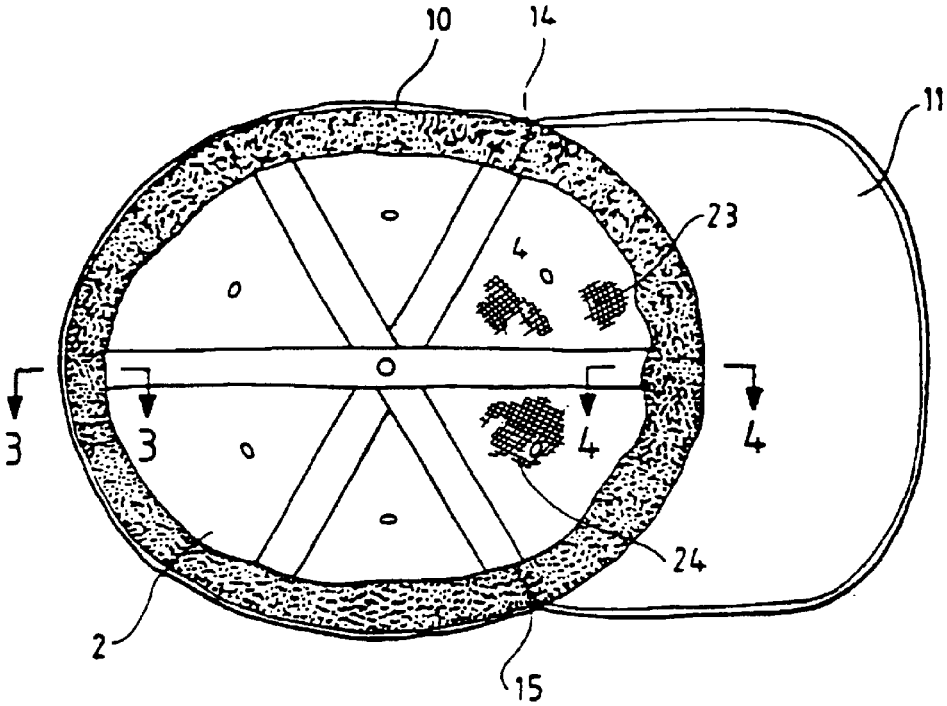
FIG. 2 is a plan view of the same cap as shown in FIG. 1.
Figure 3:
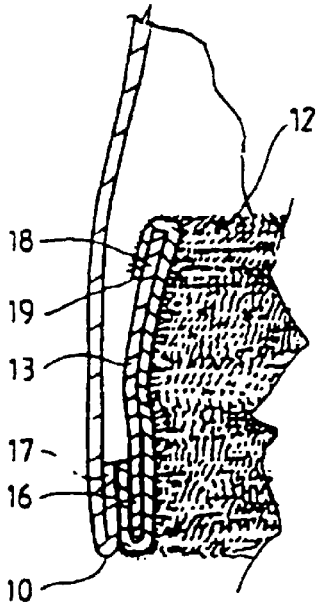
FIG. 3 is a cross-sectional view along the lines 3—3 as shown in FIG. 2.
Figure 4:
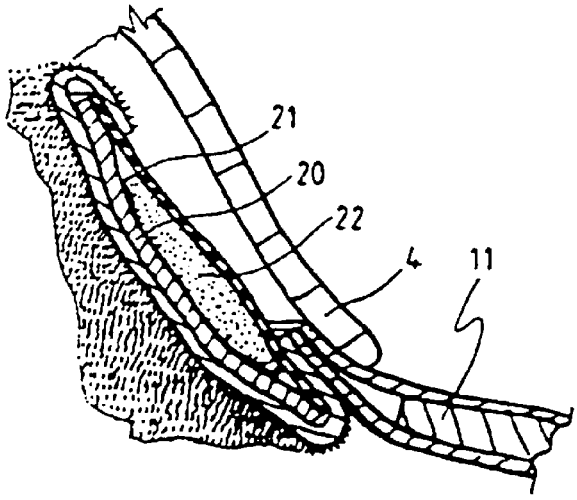
FIG. 4 is a cross-sectional view along the lines 4—4 of the cap as shown in FIG. 2.

There is accordingly, as is shown specifically in FIG. 3, an elastic band 13 which in the case of this first embodiment follows only partially the encircling path within the lower part of the crown 2 so as to be joined at about the location shown in FIG. 2 at 14 in the one case and 15 in the other to a non-elastic portion, details of which are shown more specifically in FIG. 4.

Accordingly, we have the elastic band 13 extending around the perimeter from 14 to the back of the cap and then around to the place at 15.

A lower edge 16 of this band is sewn to the lowermost encircling edge 10 of the crown and there is a towelling fabric 12 which is sewn so as to extend around the lower edge of the elastic band 13 at 17 and around the top edge of the elastic band 18 at 19.

During manufacture of the cap, the towelling 12 is sewn to the elastic band 13 while the elastic band 13 is stretched so that when the two are sewn together, the elastic band 13 can be allowed to resume its normal position but thereafter, when the elastic band joined terry towelling 12 is secured to the inner side of the cap and is worn by a person with a larger head, the stretching of the elastic band 13 will not be impeded by reason of stretching to its unreasonable limits of the towelling attached to the band.

At the front of the cap, between joining locations 14 and 15, in this embodiment there is provided beneath the fully encircling towelling 12, a cloth 20 which is combined with a plastic sheet 21 which has between them soft foamed plastic 22 which acts as a cushion between a wearer's forehead and the more rigid portion of the crown 2 which is both reinforced by the shape of the peak 11 and also the fact that the gores 4 and 5 can be reinforced with backing fabric such as at 23 and 24.

The plastic sheet together with the cloth backing and the soft plastic foam 22 together form a composite strip which extends in this pattern between locations 14 and 15 and are joined by being sewn to the elastic band 13.

A feature of the arrangement described is that because the towelling 12 fully extends around this area, it covers joins of this nature and it allows for ends of elastic bands such as at 13 which would have an unsightly appearance because of essential frame character, to be covered and therefore allow for the join to be less bulky and therefore again more comfortable to a wearer.

Figure 5:
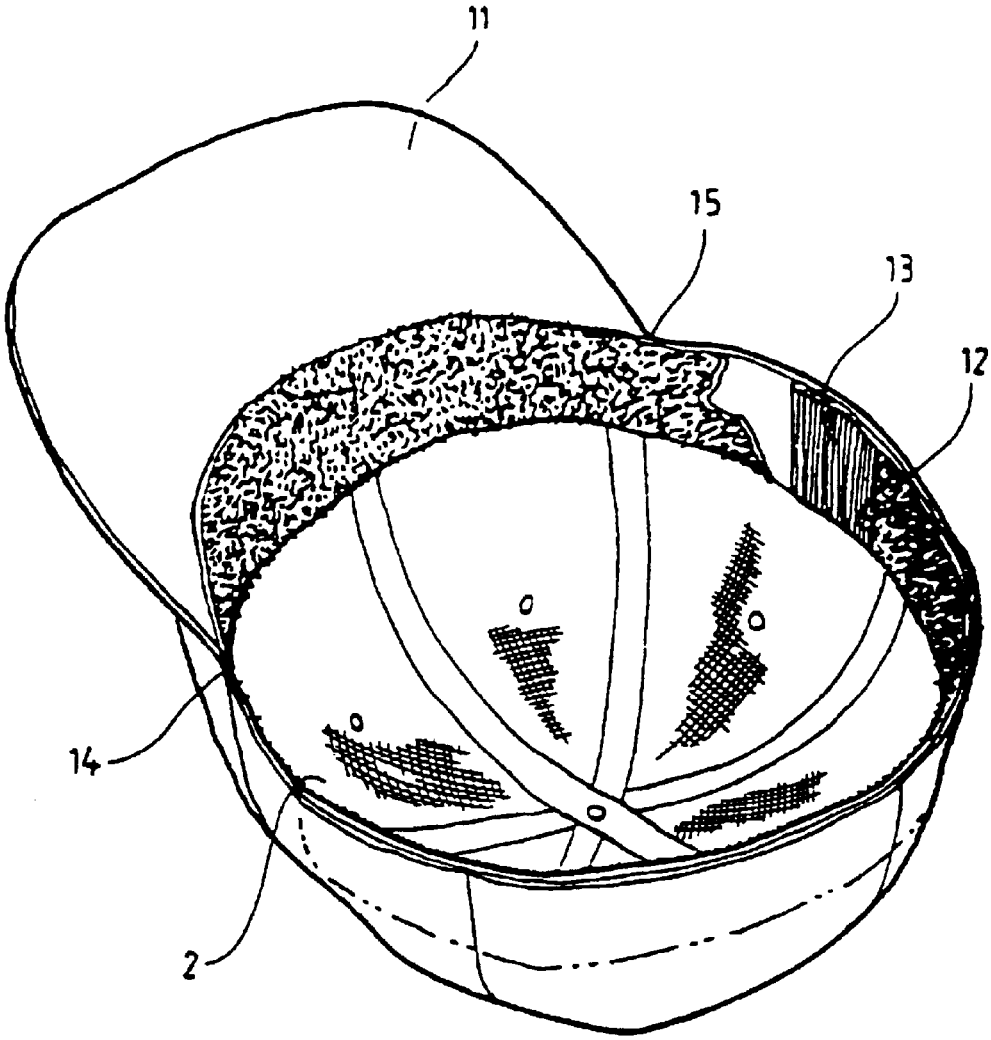
FIG. 5 is a perspective view of the cap according to the first embodiment with a part cut away on one side.
Figure 6:
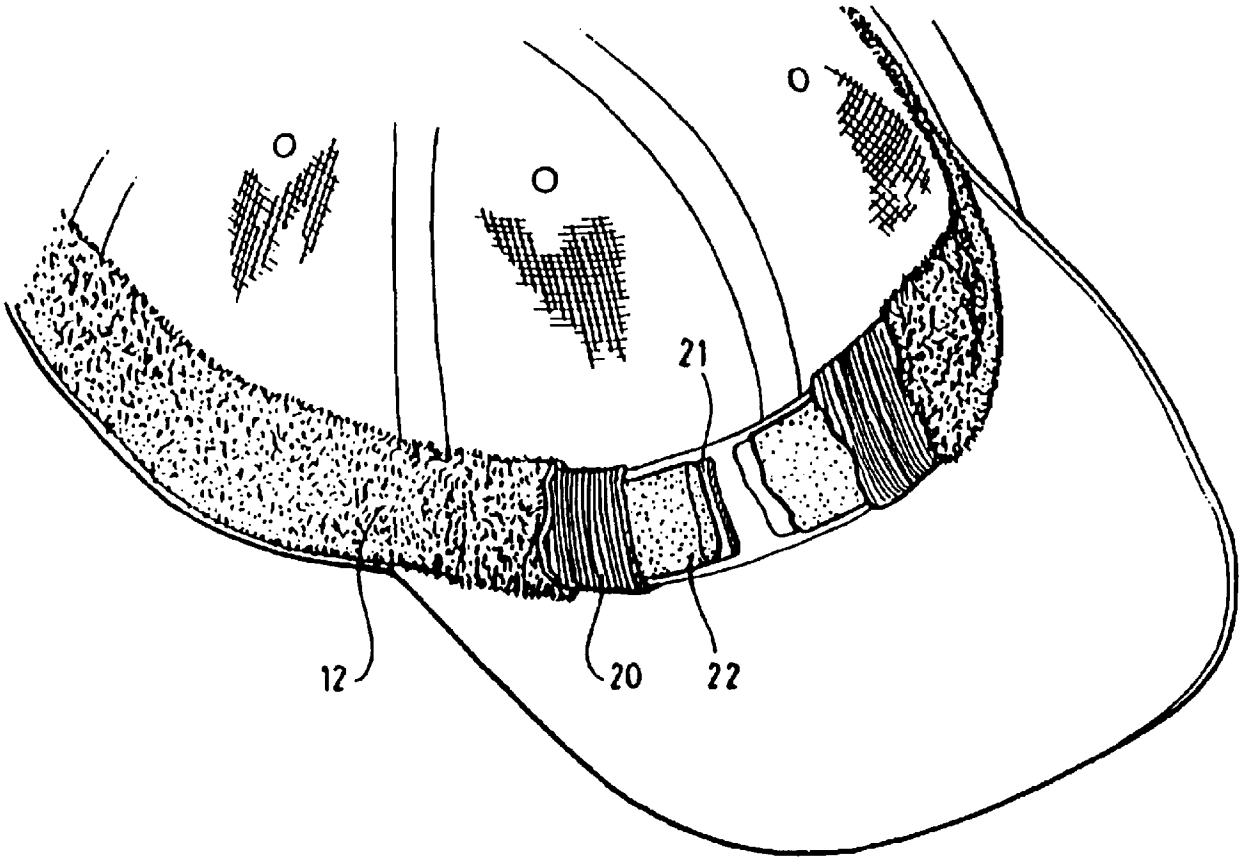
FIG. 6 is a perspective view of the same cap as described in the earlier drawings with the inner band directly behind the peak of the cap being partly cut away to show the composite nature of the inner band.

Referring specifically to FIG. 5, there is here therefore shown as a part cutaway, the band of elastic 13 which is covered by the towelling material 12.

Referring more specifically to FIG. 6, there is again then shown a cloth which is a cotton fabric 20 which forms together with a plastic sheet 21 a pocket within which there is a foam plastic 22.

The advantage of the plastic 21 is that it acts as a moisture barrier to any sweat that will be gathered and perhaps infuse within the towelling 12, through the cloth 20 and of course into the foam 22.

The advantage of providing a moisture inhibitor is that the moisture itself will then not pass fully through to the front of the cap and either show as a stain or as a wet patch, which is considered by some to be embarrassing or unsightly.

Because the now described inner band with its either substantially encircling or fully encircling innermost liner allows for a substantial stretching of the material, it is then required that the crown and especially the lower encircling edge should also be expandable with reasonable elastic tension.

The method of sewing between the inner band and the lower encircling edge of the gores is therefore chosen for this purpose, and as well, the material of the gores is both chosen and orientated so that this material will allow for this relative expansion and stretchability, whether or not it is under elastic pressure or not.

The elastic character can be either supplied by reason of the elastic band 13 or it can be, by reason of the choice of the gore material.

Such material useful for each of the gores is currently available where the weft of the woven fabric allows for stretch whereas the warp does not. If the orientation of the weft and warp of the gore material is then selected to allow for the stretch in a perimeter direction, that is generally in the direction of elongation of the inner band, then this provides the effect and the substantial fitting elasticity that is of advantage.

Generally, the fact of the liner fully extending around the inner periphery of the cap is preferred because first from an appearance point of view it looks more consistent, and secondly there is no doubt that it will therefore in all places act as an interface between the elastic and the wearer's skin.

However, it would be possible to have the inner liner substantially encircling but not fully encircling the inner periphery of the cap, so that most of the benefit is then still achieved and it is intended that the invention in its broadest sense should include the case where most but not all of the periphery is followed with the inner liner.

Figure 7:
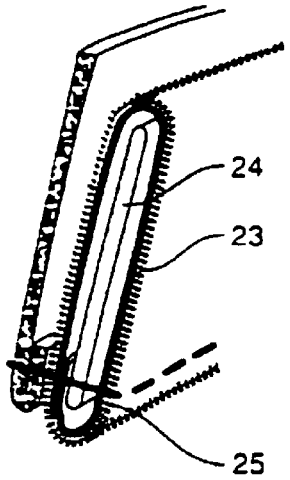
FIG. 7 is a cross sectional view of a further embodiment detail with a sleeve of terry towelling with the elastic band extending through this and being sewn along the lower encircling edge only.

Now referring to the further embodiments and particularly that shown in FIG. 7, there is provided a sleeve 23 of terry towelling with the elastic band 24 extending through this and being sewn along the lower encircling edge 25 only. By having a sleeve with the elastic band 24 constrained at only a lowermost position will allow for better freedom of stretch of the band and the towelling without a stitch line at an upper location. Any such stitch line will be somewhat limiting even though precautions such as prestretching is used.

Figure 8:
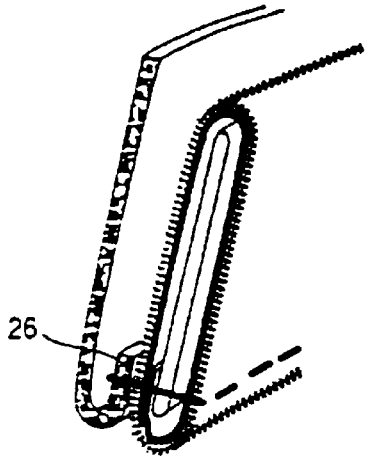
FIG. 8 is a further version with the sewing only on an inner flap.

FIG. 8 is a further version of the embodiment with the sewing only on an inner flap 26 of the respective gores where this is turned up so that a sew line does not then appear externally.

Figure 9:
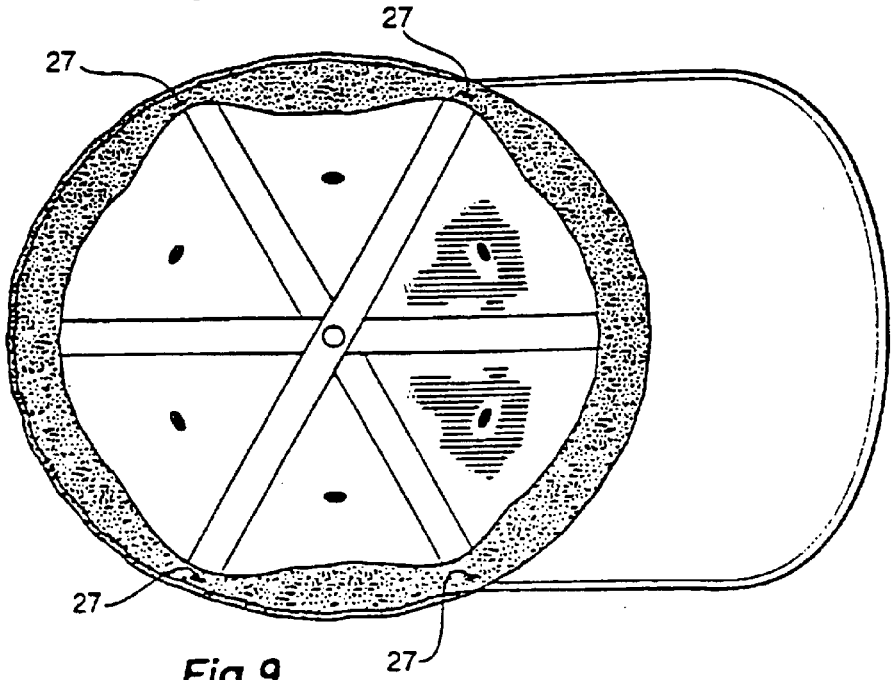
FIG. 9 illustrates how the lower encircling band that is sewn only along the lower most edge node the less has tacks higher which do not impede extensions but keep the band from dropping below the lower edge.

FIG. 9 illustrates how the lower encircling band which can in this case be either that shown in FIG. 7 or 8 is sewn only along the lower most edge but none the less has tacks 27 higher which are at substantially spaced apart intervals which do not impede elastic extension but keep the band from drooping below the lower edge e.g. 25.

Figure 10:
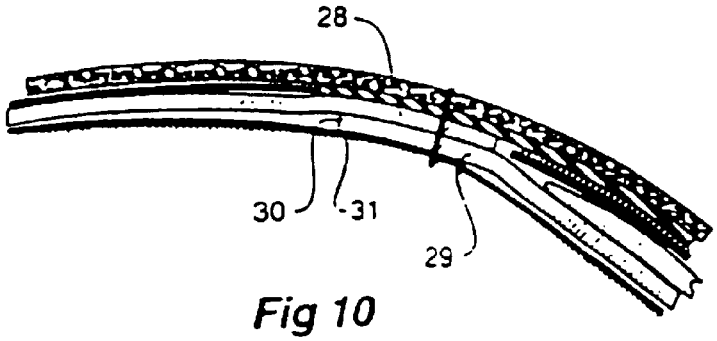
FIG. 10 is a cross sectional view of a cross over between elasticised band material showing how this can now have one to one edge joins with frayed edges because these are now covered by the liner rather than folded edges which would increase thickness and reduce comfort.

FIG. 10 is a further embodiment shown as a cross sectional view of a cross over between elasticised band material showing how this can now have one to one edge joins 28 and 29 with frayed edges 30 because this is now covered by the liner 31 rather than having folded edges to hide a frayed or potentially frayed edge which would increase thickness and reduce comfort.

As an example of the improvement obtained in stretching limits, in one embodiment in accord with FIG. 8 there has been obtained a size variation of from 55 cm inner perimeter to 65 cms inner perimeter with an increase of elastic applied pressure from zero to 60 cms of approximately 2 kilograms and to a full 65 cms of approximately 4.5 kilograms. The actual degree of stretch and the size range can be varied considerably from case to case and will depend upon the range of head sizes in a particular population.

With the range stated, most males within an average Australian community can be accommodated with the one cap which is a significant advantage to those selling caps as far as stock is concerned and for a user in that there will be a high likelihood of a fitted style cap now being available.

Referring in detail to the embodiment in FIGS. 10 through 13, there is provided a cap 100 which is formed by having a plurality of triangular shaped pieces of cloth (gores) shown typically at 101 which in each case are selected from a material providing stretchability in one direction in predominance over another by reason that of the weft and warp from which the material is woven, one of these is an elastically expandable material such as spandex. (It can in a further case be expandable in both weft and warp).

The orientation of the elastic material in each of the gores forming the crown is not chosen so as to consistently be only in one orientation with respect to the shape of the gore and it is allowed to be randomly orientated which is significantly more convenient in commercial manufacture and in practice has been found to provide sufficient stretchability for the functional purposes of allowing stretchability without excessive pressure.

Figure 11:
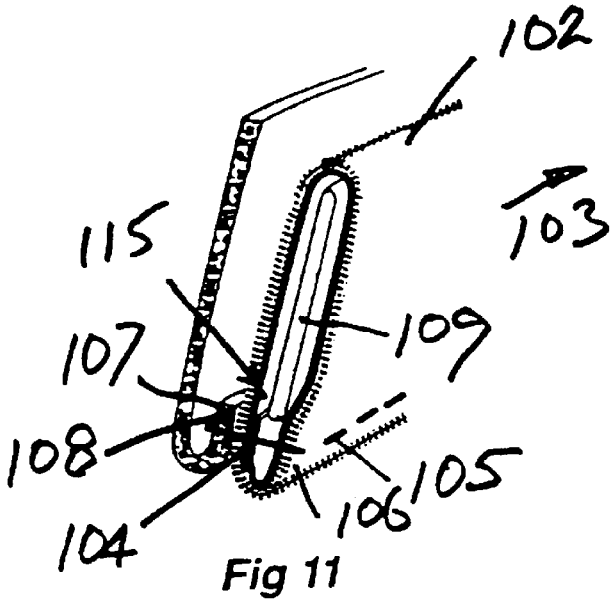
FIG. 11 is an arrangement in cross-section of the lower encircling edge of a cap according to the invention showing the sleeve forming together with an inner elastic strip, the inner band.
Figure 12:
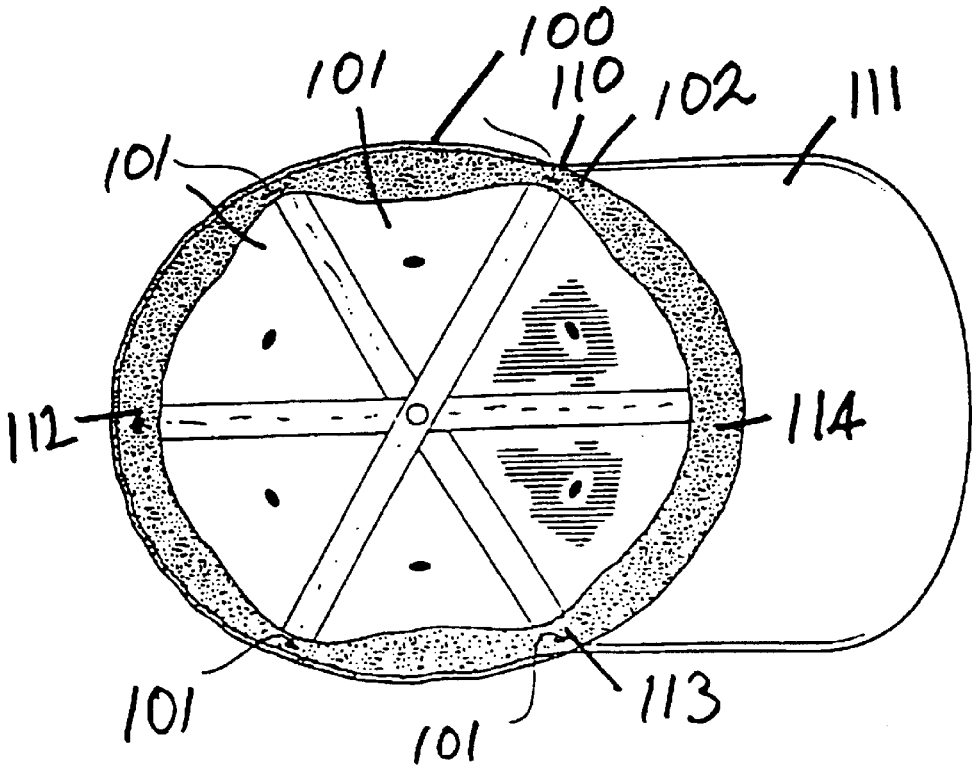
FIG. 12 is a view of a cap according to this invention showing the substantially spaced apart locations of tacks keeping the elastic band in position with the elastic band being maintained in a relative position with respect to the sleeve form.
Figure 13:
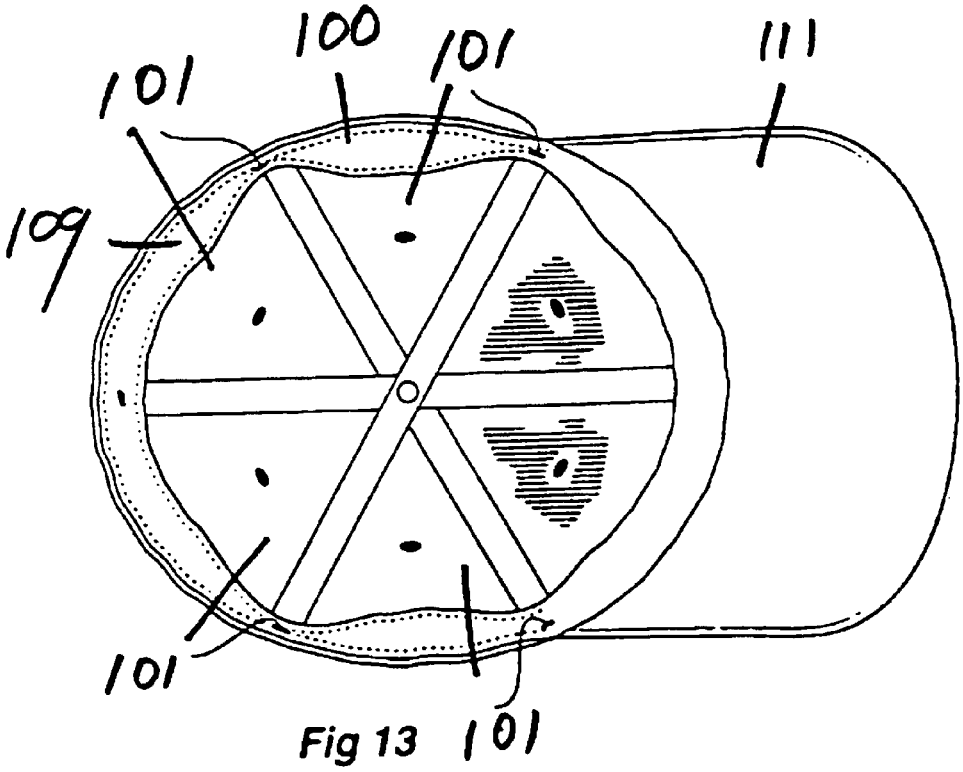
FIG. 13 is the same view as in FIG. 12 except, in this case, there is shown in dotted outline, the path of the elastic band within the sleeve.

However, this is assisted significantly by the further features which is that there is a sleeve 102 which is formed by selecting terry towelling which is cut from a roll of terry towelling and such that the orientation of the cut is so that there will be a greater degree of stretchability in the elongation direction of the sleeve which is generally shown at 103 in FIG. 11.

The terry towelling itself has an outer nap and is formed in a first case so as to have overlapping edges such as at 104 which is then kept together by a line of sewing such as at 105 which is at spaced intervals but also extends fully through the sleeve material which is to say from an inner side 106 capturing both of the outer sides where they overlap and then passing through an inwardly upturned edge.

This then leaves on the inner side 108, a stitch line which is not visible from the outside area of the cap 100 but allows any expansion potential under elastic extension, to be taken up by the stitching.

Located within the sleeve 102 is a band of elastic 109 which extends from a location at 110 which is alongside a peak 111 around the back 112 of the cap 100 to again then finish at 113 on the other side of the peak 111 of the cap 100.

Within the area 114 which is immediately behind the peak 111, we have the sleeve 101 extending continuously but within the sleeve, there is foam plastic material and this is also including an impermeable plastic sheet material to assist in limiting the amount of sweat that will extend from a wearer through to the crown material in this location.

It will be specifically observed that the lower edge of the elastic band 109 which is shown at 105, is not captured by the line of sewing at 105 and is therefore free to independently expand or move as compared to the materials defining the sleeve 102.

There could, however, be a problem if this elastic band material was left to be totally free so that it could in fact ride and gather under usage into a collected upper portion of the sleeve 102 and for this reason it is tacked at spaced apart locations which are chosen simply to ensure that there is a sufficient ensnaring of the band so as to keep this in a relatively spread position with respect to the sleeve 101.

In a further example while the nap of terry towelling is positioned on the outer side of the material, in a further example the nap is positioned on an inner side of the sleeve. This provides an advantage that the lowermost edge may appear to be slightly cleaner without portions of nap possibly dangling below a lowermost edge of a crown.

By using these techniques, it has been discovered that there is a significant advantage achieved both in terms of allowing for a cap that can now be provided for a large group of people having different head sizes who can now wear this cap without having it to be adjusted for their particular head size.

This has also significant advantage in that the cap itself looks to be a tailored cap for the particular wearer and this is considered very important by many who are fashion conscious or otherwise concerned as to the appearance.

It also has significant advantage to persons selling such caps.

The amount of stock that is necessary for a particular colour or design is now reduced significantly so that a retailer will not have to hold one or more caps of each size variant and will be able to generally service customers who require any size cap.

A further significant advantage is that by having the soft interface, the cap itself in the embodiment can be worn over a period of time with a high degree of comfort even at the maximum stretch.

What is claimed is:

1. A head covering having a crown with a lower encircling edge in a circumferential direction, an inner band within the crown having a lowermost edge secured to, at least, the lower encircling edge of the crown, the crown being formed to be elastically stretchable to provide for elastic extension of the inner encircling edge of the crown, the band having a portion less than 360% in said circumferential direction and being elastically stretchable at the least along its direction of elongation in said circumferential direction, the band including a linear positioned so as to have at least a portion of the liner on the inner side of elastic material of the band facing away from the crown.

2. A cap having a crown with a lower encircling edge in a circumferential direction, a peak extending outwardly from a portion only of the lower encircling edge, an inner band within the crown having a lowermost edged secured to, at least, the lower encircling edge of the crown, the band being elastically stretchable at the least along its direction of elongation and extending less than fully around the inner perimeter of the lower encircling edge, the crown being formed to be elastically stretchable to provide for elastic extension of the inner encircling edge of the crown and a knitted liner secured so as to be positioned at the least on an inner side of the band facing away from the crown and extending fully around the inner perimeter of the lower encircling edge.

3. A cap as claimed in claim 1 or 2 wherein the crown is formed of a plurality of gores which are of a material which will stretch at the least so as to elastically allow for a change in size of at least the lower encircling edge of the crown.

4. A cap as claimed in claim 1 or 2 wherein the material of at least one of the gores is woven so that the woven strands in one direction as in the weft allow for elastic stretching while the strands in the other direction as in the warp do not allow for substantial elastic stretching.

5. A cap as claimed in claim 2 wherein the inner band is a single band and includes a sheet of material positioned between the inner band and the material of the gores to resist passage of sweat from the wearer therepast.

6. A cap as claimed in claim 1 or 2 wherein the inner band is both elastic and stretchable by reason of being a knitted material having a plurality of strands some of which allow for substantial elasticity where the direction of elongation of such elastic strands are in the direction of elongation of the band.

7. A cap as claimed in claim 1 or 2 wherein the inner band includes material providing substantially elasticity in its elongation direction for a portion only of the inner perimeter of the encircling edge and there is provided for a remainder of the perimeter that the band is comprised of a material that does not exhibit substantial elasticity.

8. A cap as claimed in claim 1 or 2 wherein there are two gores forming the crown which are at the front of the cap and there is a stiffening reinforcement positioned behind and secured to each of the gores so as to assist in maintaining a selected shape of the gores.

9. A cap as claimed in claim 1 or 2 wherein the inner liner is knitted cotton toweling..

10. A cap having a crown with a lower encircling edge in a circumferential direction, a peak extending outwardly from a portion only of the lower encircling edge, an inner band positioned to extend around the lower encircling edge and within the crown having a lowermost edge secured to the lower encircling edge of the crown, the crown being formed to be elastically stretchable to provide for elastic extension of the lower encircling edge of the crown, the band being elastically stretchable at the least along its direction of elongation and extending at least substantially around the inner perimeter of the lower encircling edge, and a liner secured to be on an inner side of the band facing away from the crown and extending to at least a substantial extent around the inner perimeter of the lower encircling edge.

11. A cap as claimed in claim 10 wherein the inner liner is knitted fabric.

12. A cap as claimed in claim 10 or 11 wherein the liner is in the form of a sleeve through which the band extends, one side edge of the sleeve only, being secured to the lower encircling edge of the crown.

13. A cap as claimed in claim 1 or 10 wherein the liner is terry towelling material which is selected from terry towelling which is provided from a roll of terry towelling where the direction of the knitting is chosen so that there will be, in the elongation direction of this sleeve, a stretch potential which is greater than the stretch potential in a transverse direction.

14. A cap as claimed in claim 10 wherein an elastic strip is a band which is held fully within the sleeve formed from the terry towelling and which is secured to the sleeve only at substantially spaced apart locations.

15. A cap as claimed in claim 14 wherein the elastic strip is secured by being sewn to the terry toweling only thereby allowing said elastic strip to stretch in a way that is separate from restraints applied by a particular form of sewing.

16. A cap as claimed in claim 14 wherein the elastic strip is secured at a spacing of approximately each of a quarter circular distance around the cap.

17. A method of manufacture of a cap as claimed in claim 9 including the step of stretching the knitted cotton towelling while it is being secured to an elastic portion of the inner band and the combination being then secured to the lower encircling edge of the cap while not being stretched.

18. A cap as claimed in claim 17 wherein the terry towelling is folded so as to provide a sleeve shape.

19. A cap as claimed in claim 18 wherein the sleeve shape has overlapping edges which are in the vicinity of the lower encircling edge and are sewn to an upturned inner portion of the crown at this location.

20. A head covering as claimed in claim 1 including a brim extending outwardly from the lower encircling edge.

21. A head covering as claimed in claim 1 including a fully encircling brim extending outwardly from the lower encircling edge elastically extendible material.

* * * * *